US007188397B2

(12) United States Patent
Hartgrove et al.

(10) Patent No.: US 7,188,397 B2
(45) Date of Patent: Mar. 13, 2007

(54) FLAME-RETARDANT IMAGED NONWOVEN FABRIC

(75) Inventors: Herbert Parks Hartgrove, Angier, NC (US); Sergio Diaz de Leon, Mooresville, NC (US); Samuel Keith Black, Garner, NC (US); Friso Joost Hijenga, Rotterdam (NL)

(73) Assignee: Polymer Group, Inc., Charlotte, NC (US)

( * ) Notice: Subject to any disclaimer, the term of this patent is extended or adjusted under 35 U.S.C. 154(b) by 0 days.

(21) Appl. No.: 11/132,027

(22) Filed: May 18, 2005

(65) Prior Publication Data

US 2005/0204526 A1 Sep. 22, 2005

Related U.S. Application Data

(62) Division of application No. 10/021,456, filed on Dec. 13, 2001, now Pat. No. 6,930,064.

(60) Provisional application No. 60/255,842, filed on Dec. 15, 2000.

(51) Int. Cl.

| | |
|---|---|
| ***D06C 23/00*** | (2006.01) |
| ***D04H 5/08*** | (2006.01) |
| *B32B 5/26* | (2006.01) |
| *B32B 7/08* | (2006.01) |

(52) U.S. Cl. ..... 28/104; 427/389.9; 442/408; 442/146; 428/172; 428/920; 428/921

(58) Field of Classification Search ..... 428/920, 428/921; 442/136; 28/104; 8/497, 922, 8/445; 427/412

See application file for complete search history.

(56) References Cited

U.S. PATENT DOCUMENTS

| | | | | |
|---|---|---|---|---|
| 3,485,706 | A | 12/1969 | Evans | |
| 3,498,936 | A | 3/1970 | Wilson et al. | |
| 3,663,269 | A | 5/1972 | Fischer et al. | |
| 3,917,785 | A * | 11/1975 | Kalwaites | 264/108 |
| 3,934,285 | A | 1/1976 | May | |
| 3,966,406 | A | 6/1976 | Namiki et al. | |
| 4,320,163 | A | 3/1982 | Schwartz | |
| 4,780,359 | A | 10/1988 | Trask et al. | |

(Continued)

FOREIGN PATENT DOCUMENTS

| | | |
|---|---|---|
| JP | 3-251452 | 11/1991 |

(Continued)

OTHER PUBLICATIONS

PCT International Search Report, PCT/US01/48902, mailed May 6, 2002.

*Primary Examiner*—Jenna-Leigh Befumo
(74) *Attorney, Agent, or Firm*—Wood, Phillips, Katz, Clark & Mortimer

(57) ABSTRACT

A method of forming flame-retardant nonwoven fabrics by hydroentanglement includes providing a precursor web. The precursor web is subjected to hydroentanglement on a three-dimensional image transfer device to create a patterned and imaged fabric. Treatment with a flame-retardant binder enhances the integrity of the fabric, permitting the nonwoven to exhibit desired physical characteristics, including strength, durability, softness, and drapeability. The treated nonwoven may then be dyed by means applicable to conventional wovens.

18 Claims, 6 Drawing Sheets

U.S. PATENT DOCUMENTS

| | | | |
|---|---|---|---|
| 4,830,897 | A | 5/1989 | Lichetnstein |
| 5,098,764 | A | 3/1992 | Bassett et al. |
| 5,252,386 | A | 10/1993 | Hughes et al. |
| 5,389,716 | A | 2/1995 | Graves |
| 5,437,690 | A | 8/1995 | Caldwell et al. |
| 5,437,904 | A | 8/1995 | Boulanger et al. |
| 5,440,771 | A | 8/1995 | Georgantas |
| 5,822,833 | A | 10/1998 | James et al. |
| 6,596,658 | B1 * | 7/2003 | Putnam et al. ..... 442/384 |

FOREIGN PATENT DOCUMENTS

| | | |
|---|---|---|
| JP | 10-131097 | 5/1998 |
| JP | 10-168756 | 6/1998 |
| JP | 11-335958 | 12/1999 |
| WO | WO 01/53578 A1 | 7/2001 |

* cited by examiner

FLAME-RETARDANT IMAGED NONWOVEN FABRIC

CROSS-REFERENCE TO RELATED APPLICATION

This application is a division of U.S. Ser. No. 10/021,456, filed Dec. 13, 2001 now U.S. Pat. No. 6,930,064, which claims the benefit of priority Provisional Application No. 60/255,842, filed Dec. 15, 2000, the disclosures of which are incorporated herein by reference.

TECHNICAL FIELD

The present invention relates generally to methods of making nonwoven fabrics, and more particularly to a method of manufacturing three-dimensional imaged nonwoven fabrics exhibiting flame-retardant characteristics while retaining aesthetic appeal, abrasion resistance, and fabric strength, these properties permitting use of the fabric in wall cover applications.

BACKGROUND OF THE INVENTION

Significant quantities of textile fabric are employed in the construction of domestic and business furnishings, room dividers and acoustic panels. Manufactures of such textile fabrics are cognizant of the end-use of their materials in these constructions and have looked to improve the aesthetic qualities of the fabrics. Further, manufactures have also taken safety into consideration and looked to ways in which the textile fabric can be imparted with improved levels of flame retardancy.

The production of conventional textile fabrics is known to be a complex, multi-step process. The production of fabrics from staple fibers begins with the carding process where the fibers are opened and aligned into a feedstock known as sliver. Several strands of sliver are then drawn multiple times on drawing frames to further align the fibers, blend, improve uniformity as well as reduce the diameter of the sliver. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarn packages (which run in the cross direction and are known as picks) are taken straight to the loom for weaving. The warp yarns (which run on in the machine direction and are known as ends) must be further processed. The packages of warp yarns are used to build a warp beam. Here the packages are placed onto a warper, which feeds multiple yarn ends onto the beam in a parallel array. The warp beam yarns are then run through a slasher where a water-soluble sizing is applied to the yarns to stiffen them and improve abrasion resistance during the remainder of the weaving process. The yarns are wound onto a loom beam as they exit the slasher, which is then mounted onto the back of the loom. Here the warp and fill yarns are interwoven in a complex process to produce yardages of textile fabric.

In contrast, the production of nonwoven fabrics from staple fibers is known to be more efficient than traditional textile processes as the fabrics are produced directly from the carding process with a topical treatment of the nonwoven fabric readily being applied.

Nonwoven fabrics are suitable for use in a wide-variety of applications where the efficiency with which the fabrics can be manufactured provides a significant economic advantage for these fabrics versus traditional textiles. However, nonwoven fabrics have commonly been disadvantaged when fabric properties are compared, particularly in terms of surface abrasion, pilling and durability in multiple-use applications. Hydroentangled fabrics have been developed with improved properties, which are a result of the entanglement of the fibers or filaments in the fabric providing improved fabric integrity. Subsequent to entanglement, fabric durability can be further enhanced by the application of binder compositions and/or by thermal stabilization of the entangled fibrous matrix. However, the use of such means to obtain fabric durability comes at the cost of a stiffer and less appealing fabric.

The resulting textile or nonwoven fabric requires further processing before a suitable material is available for the construction of furnishings. Fabric constructed by either mechanism is essentially planar, having little in way of macroscopic asperities, let alone, a three-dimensional aesthetic quality. It has been necessary in the art to further treat the fabric with embossing techniques or complex foaming agents in order to impart the fabric with a multi-planar, aesthetic quality. In addition, depending upon whether or not the textile fabric was woven from costly flame-retardant staple fiber, a subsequent topical treatment containing an appropriate flame-retardant chemistry is required.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as an aesthetically pleasing appearance.

In preparing an imaged nonwoven material by the present invention for use in furnishings, the material has also been found to have inherent physical properties that render the material eminently suitable for wall coverings, window coverings, upholstery, and drapery applications, which are hereby referenced as co-pending applications.

Heretofore, attempts have been made to develop flame-retardant nonwoven fabrics exhibiting the necessary aesthetic and physical properties for durable consumer applications.

U.S. Pat. No. 4,320,163, to Schwartz, hereby incorporated by reference, discloses a three-dimensional ceiling board facing. This patent contemplates selectively coating a flame-retardant substrate with a print paste consisting of a foamable plastisol. By then exposing said-coated substrate to an elevated temperature, the plastisol increases variably in height under the influence of expanding thermoplastic microspheres, forming a roughened or "pebbled" surface.

A construct is disclosed in U.S. Pat. No. 4,830,897, to Seward, whereby an initial woven textile fabrics receives thereupon a heat dissipating metallic foil followed by a fibrous batt. The application of a subsequent mechanical needling procedure integrates the layers into a unitary construct.

There are a number of Japanese patents directed to nonwoven fabrics used as a component in wall covering fabrication. JP10168756 to Kawano, et al., utilizes a flame-retardant spunbond containing diguanidine phosphate laminated to a wallpaper backing. A wallpaper is disclosed in JP10131097 to Takeuchi, et al., whereby a nonowoven fabric is adhesively bonded to wallpaper backing, the adhesive containing a significant amount of a high specific gravity fireproofing agent. JP3251452 to Nakakawara, et al., discloses an alternate foam texturing process wherein a uniform foam layer is initially applied to a nonwoven substrate, then a solvent is printed thereon to reductively pattern the laminate. A final patent of interest is JP11335958 to Nanbae, et al., whereby a two layered nonwoven fabric, each layer consisting of less than 20% thermally fusible fibers is subjected to an embossing process.

As can be seen in the prior art, there has not been an effective melding of three-dimensional aesthetic qualities with flame-retardant properties in a fabric suitable for furnishing, window covering, and wall covering applications.

SUMMARY OF THE INVENTION

In accordance with the present invention, a method of making a nonwoven fabric embodying the present invention includes the steps of providing a precursor web comprising a fibrous matrix. While use of staple length fibers is typical, the fibrous matrix may comprise substantially continuous filaments and combinations thereof. In a particularly preferred form, a staple length fibrous matrix is carded and cross-lapped to form a precursor web. It is also preferred that the precursor web be subjected to pre-entangling on a foraminous forming surface prior to imaging and patterning.

The present method further contemplates the provision of a three-dimensional image transfer device having a movable imaging surface. In a typical configuration, the image transfer device may comprise a drum-like apparatus that is rotatable with respect to one or more hydroentangling manifolds.

The precursor web is advanced onto the imaging surface of the image transfer device so that the web moves together with the imaging surface. Hydroentanglement of the precursor web is effected to form an imaged and patterned fabric.

After hydroentanglement, the imaged and patterned fabric is treated with a flame-retardant binder composition. The treated and imaged nonwoven fabric may then be subjected to one or more variety of post-entanglement treatments. Such treatments include dyeing of the fabric by conventional textile dyeing methods.

A method of making the present durable nonwoven fabric comprises the steps of providing a precursor web that is subjected to hydroentangling. Fibrous precursor webs, in either homogeneous form or in a blend with other polymeric and/or natural fibers or webs, have been found to desirably yield soft hand and good fabric drapeability. The precursor web is formed into an imaged and patterned nonwoven fabric by hydroentanglement on a three-dimensional image transfer device. The image transfer device defines three-dimensional elements against which the precursor web is forced during hydroentangling, whereby the fibrous constituents of the web are imaged and patterned by movement into regions between the three-dimensional elements of the transfer device.

In the preferred form, the precursor web is hydroentangled on a foraminous surface prior to hydroentangling on the image transfer device. This pre-entangling of the precursor web acts to partially integrate the fibrous components of the web, but does not impart imaging and patterning as can be achieved through the use of the three-dimensional image transfer device.

After hydroentangling, the imaged and patterned nonwoven fabric is treated with a flame-retardant binder finish to lend further integrity to the fabric structure. The polymeric binder composition is selected to enhance flame-retardancy and durability characteristics of the fabric, while maintaining the desired softness and drapeability of the patterned and imaged fabric.

Other features and advantages of the present invention will become readily apparent from the following detailed description, the accompanying drawings, and the appended claims.

BRIEF DESCRIPTION OF THE DRAWINGS

The invention will be more easily understood by a detailed explanation of the invention including drawings. Accordingly, drawings, which are particularly suited for explaining the invention, are attached herewith; however, it should be understood that such drawings are for explanation purposes only and are not necessarily to scale. The drawings are briefly described as follows.

DETAILED DESCRIPTION

Figure 1:
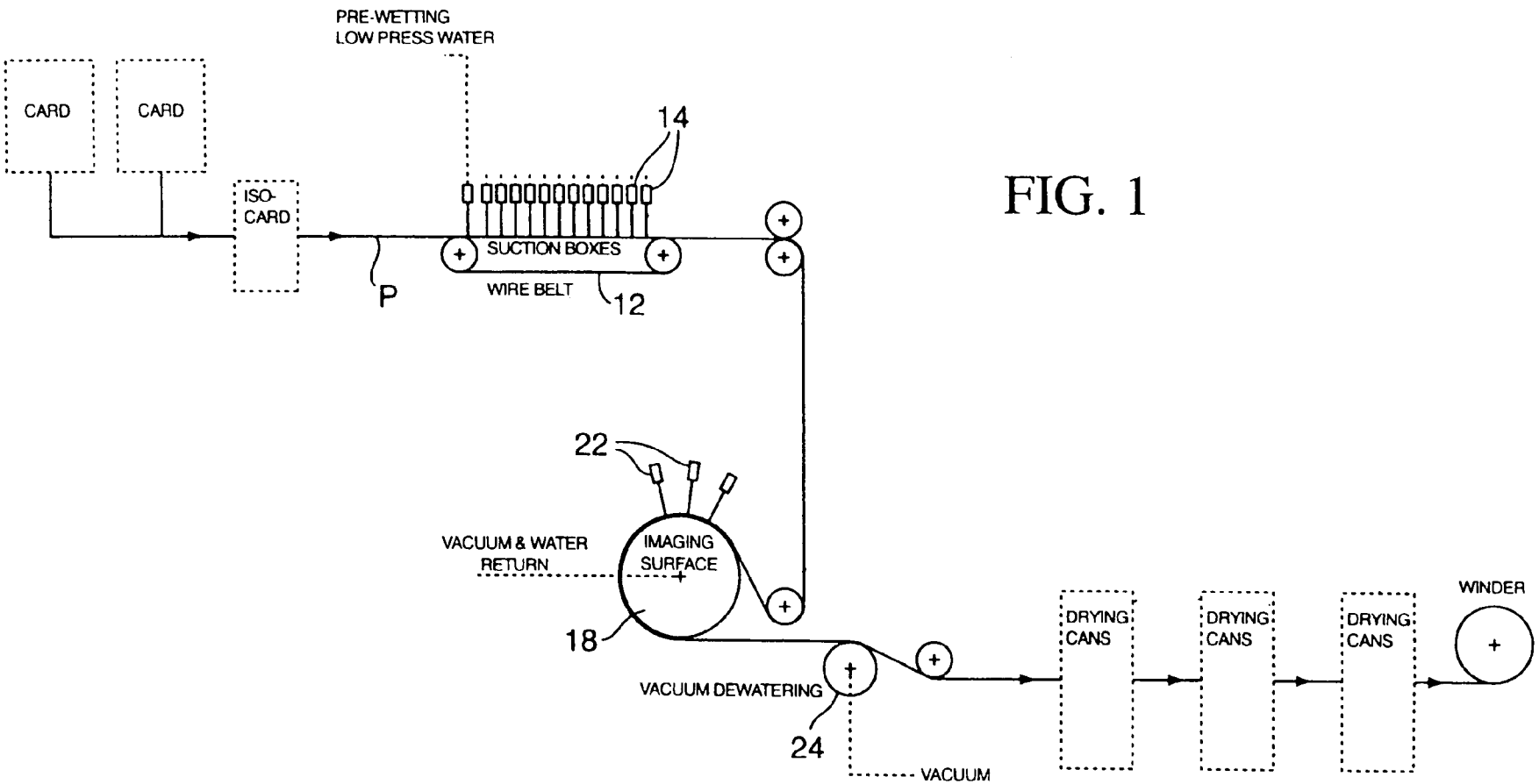
FIG. 1 is a diagrammatic view of an apparatus for manufacturing a durable nonwoven fabric, embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

In accordance with the present invention, a durable flame-retardant nonwoven fabric can be produced which can be employed in a wide variety of wall coverings described as applied to wallpaper. It should be understood, however, that upon suitable modification the invention can be adapted for use with cloth, wood veneer, plastic or combinations thereof, as exemplified by U.S. Pat. No. 3,663,269 to Fischer et al., hereby incorporated by reference, with the fabric exhibiting sufficient flame-retardancy, drapeability, abrasion resistance, strength, and tear resistance, with colorfastness to light. It has been difficult to develop nonwoven fabrics that achieve the desired hand, drape, and pill resistance that are inherent in woven fabrics.

In the case where nonwoven fabrics are produced using staple length fibers, the fabric typically has a degree of exposed surface fibers that will abrade or "pill" if not sufficiently entangled, and/or not treated with the appropriate polymer chemistries subsequent to hydroentanglement. The present invention provides a finished fabric that can be conveniently cut, sewn, and packaged for retail sale or utilized as a component in the fabrication of a more complex article. The cost associated with designing/weaving, fabric preparation, dyeing and finishing steps can be desirably reduced.

With reference to FIG. 1, therein is illustrated an apparatus for practicing the present method for forming a nonwoven fabric. The fabric is formed from a fibrous matrix preferably comprising staple length fibers, but it is within the purview of the present invention that different types of fibers, or fiber blends, can be employed. The fibrous matrix is preferably carded and cross-lapped to form a precursor web, designated P. In current embodiments, the precursor web comprises staple length polyester fibers, particularly polyester having an independent level of flame-retardancy.

FIG. 1 illustrates a hydroentangling apparatus for forming nonwoven fabrics in accordance with the present invention. The apparatus includes a foraminous forming surface in the form of belt 12 upon which the precursor web P is positioned for pre-entangling by entangling manifold 14.

The entangling apparatus of FIG. 1 further includes an imaging and patterning drum 18 comprising a three-dimensional image transfer device for effecting imaging and patterning of the lightly entangled precursor web. The image transfer device includes a moveable imaging surface which moves relative to a plurality of entangling manifolds 22 which act in cooperation with three-dimensional elements defined by the imaging surface of the image transfer device to effect imaging and patterning of the fabric being formed.

Manufacture of a durable nonwoven fabric embodying the principles of the present invention is initiated by providing the precursor nonwoven web, preferably in the form of a 100% flame-retardant polyester or polyester blend. The use of the polyester desirably provides drape, which upon treatment with the specific binder formulation listed herein, results in a material with improved flame retardant properties at relatively low cost. During invention development, fibrous layers comprising flame-retardant polyester, standard polyester, p-aramid, n-aramid, melamine, and modacrylic fibers in blend ratios between about 100% by weight to 20% by weight minor component to 80% by weight major component were found effective. Such blending of the layers in the precursor web was also found to yield aesthetically pleasing color variations due to the differential absorption of dyes during the optional dyeing steps.

After formation and integration of the imaged and patterned nonwoven fabric, a flame-retardant binder finish is applied. The flame-retardant binder finish includes chemistries to render the treated fabric the ability to resist advanced thermal degradation and flame progression when exposed to combustion temperatures. A preferred chemistry employed herein is based on a halogenated derivative of a polyurethane backbone. Additional chemistries, including metallic salt extinguisants, can be used in conjunction with the halogenated polyurethane.

Upon application and curing of the flame-retardant binder finish on the imaged nonwoven fabric, the resulting fabric can be dyed by conventional textile dying methods. Various dyeing methods commonly known in the art are applicable including nip, pad, and jet, with the use of a jet apparatus and disperse dyes, as represented by U.S. Pat. No. 5,440,771 and U.S. Pat. No. 3,966,406, both hereby incorporated by reference, being most preferred.

EXAMPLES

Example 1

Using a forming apparatus as illustrated in FIG. 1, a nonwoven fabric was made in accordance with the present invention by providing a carded, randomized precursor fibrous batt comprising Type DPL 535 flame-retardant polyester fiber, 1.5 denier by 1.5 inch staple length, as obtained from Fiber Innovation Technology of North Carolina. The web had a basis weight of 2.8 ounces per square yard (plus or minus 7%).

Prior to patterning and imaging of the precursor web, the web was entangled by a series of entangling manifolds such as diagrammatically illustrated in FIG. 1. FIG. 1 illustrates disposition of precursor web P on a foraminous forming surface in the form of belt 12, with the web acted upon by entangling manifolds 14. In the present examples, each of the entangling manifolds included three each 120 micron orifices spaced at 42.3 per inch, with the manifolds successively operated at 3 strips each at 100, 300, 800 and 800 psi, at a line speed of 60 feet per minute.

The entangling apparatus of FIG. 1 further includes an imaging and patterning drum 18 comprising a three-dimensional image transfer device for effecting imaging and patterning of the now-entangled precursor web. The entangling apparatus includes a plurality of entangling manifolds 22 that act in cooperation with the three-dimensional image transfer device of drum 18 to effect patterning of the fabric. In the present example, the three entangling manifolds 22 were operated at 2800 psi, at a line speed which was the same as that used during pre-entanglement.

Figure 4:
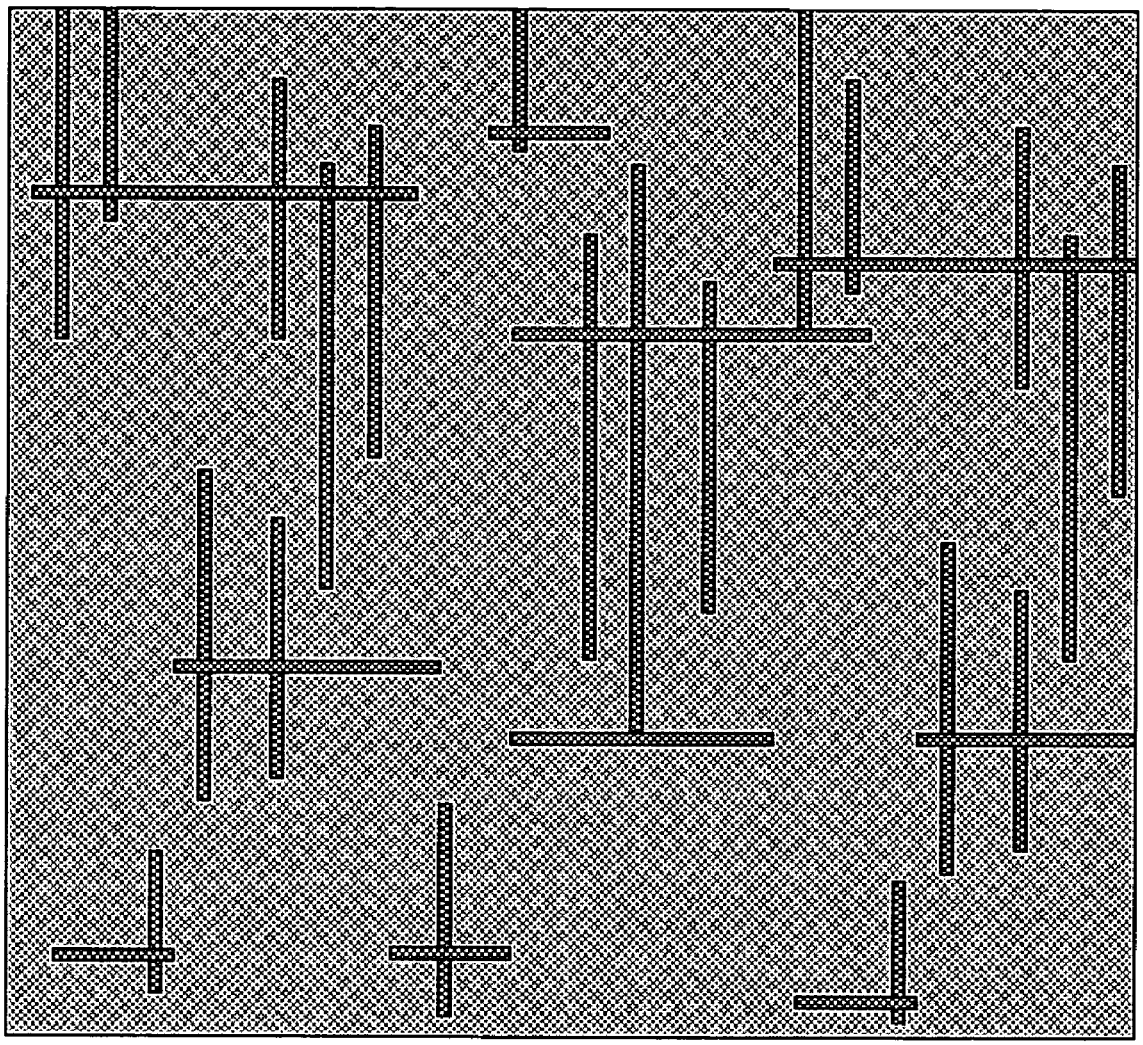
FIG. 4 is a fragmentary top plan view of a three-dimensional image transfer device of the type used for practicing the present invention, referred to as "cross slubs"
Figure 5:
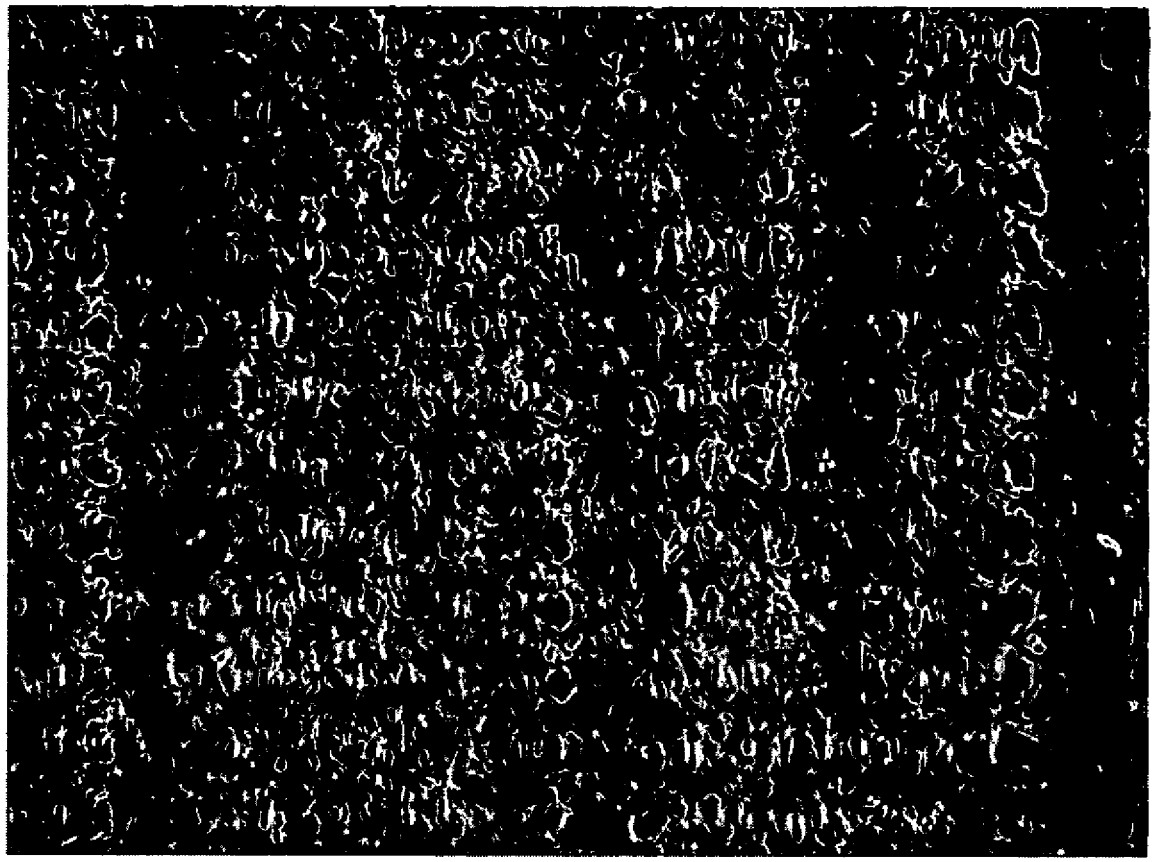
FIG. 5 is a photograph of the resultant material utilizing the image transfer device depicted in FIG. 3.
Figure 6:
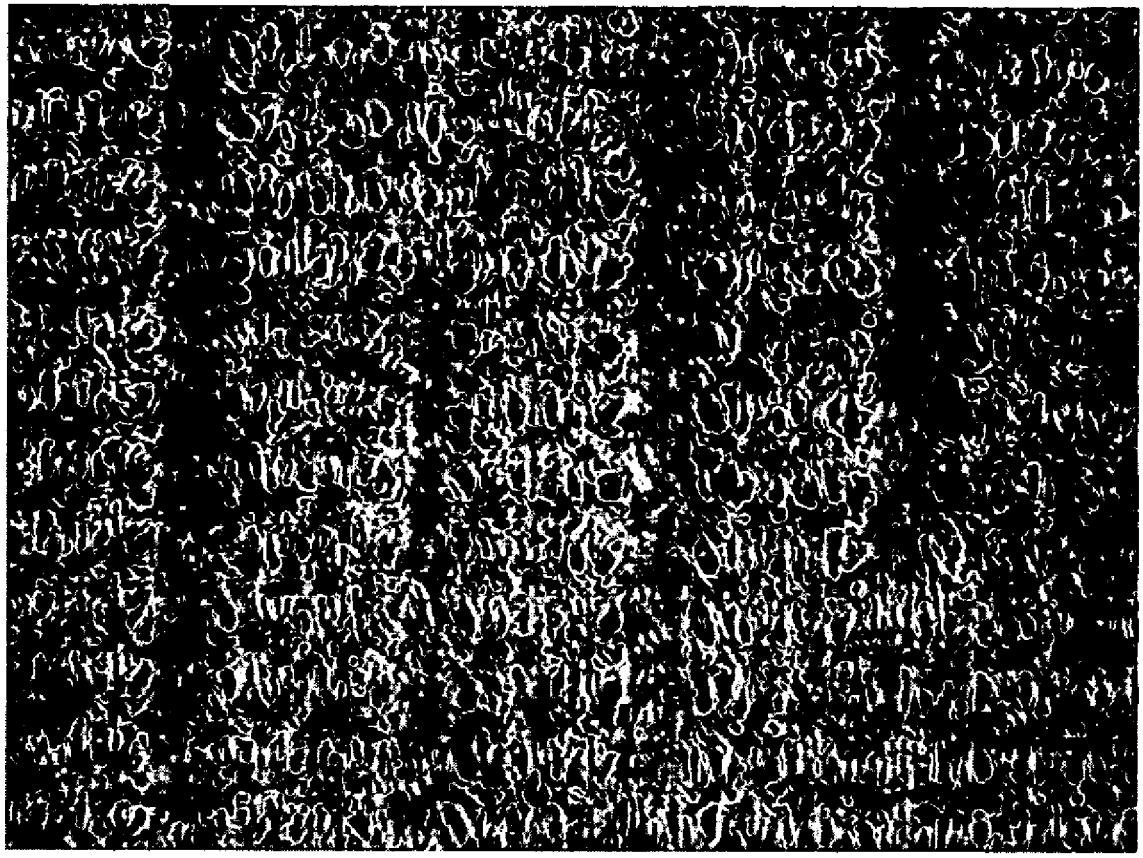
FIG. 6 is a photograph of the resultant material utilizing the image transfer device depicted in FIG. 5.

The three-dimensional image transfer device of drum 24 was configured as a so-called cross-slubs, as illustrated in FIG. 4.

Figure 2:
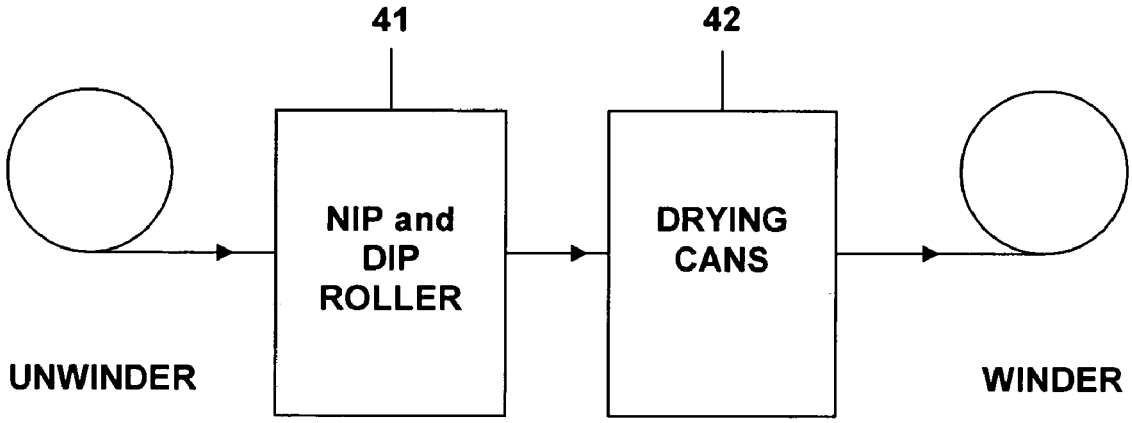
FIG. 2 is a diagrammatic view of an apparatus for the application of a flame-retardant finish onto a nonwoven fabric, embodying the principles of the present invention.
Figure 3:
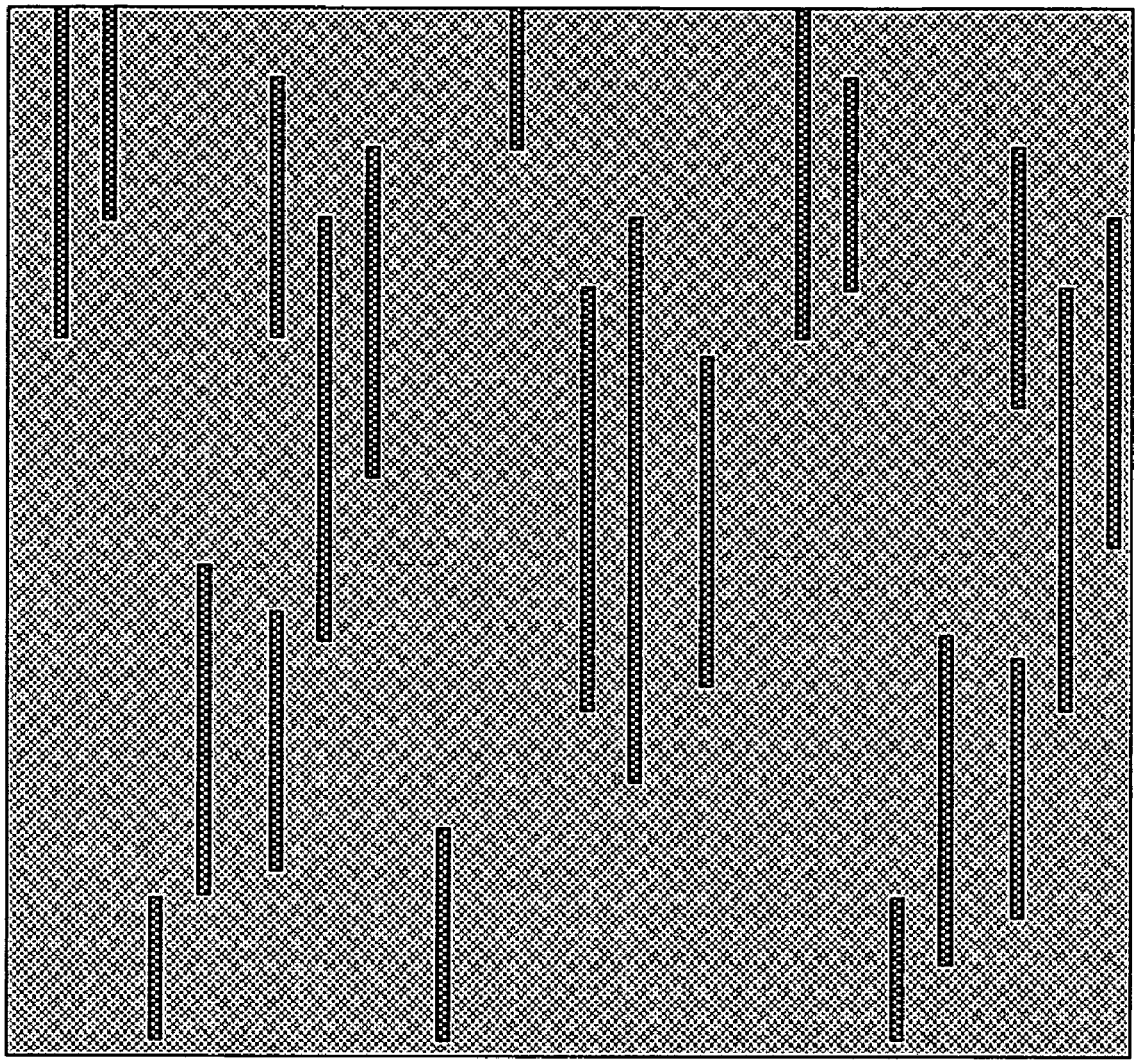
FIG. 3 is a fragmentary top plan view of a three-dimensional image transfer device of the type used for practicing the present invention, referred to as "slubs"

Subsequent to patterned hydroentanglement, the fabric was dried on three consecutive steam cans at about 275° F., then received a substantially uniform application by dip and nip saturation of a flame-retardant binder composition at application station 40 in FIG. 2. The web was then directed through three consecutive steam cans 41, operated at about 250° F.

In the present example, the pre-dye finish composition was applied at a line speed of 60 feet per minute, with a nip pressure of 32 pounds per square inch and percent wet pick up of approximately 125%.

The flame retardant finish formulation, by weight percent of bath, was as follows:

| | |
|---|---|
| Water | 90% |
| Vycar 460 × 46 [vinyl chloride acrylic co-polymer binder] | 10% |

As is registered to and can be obtained from B.F. Goodrich of Akron, Ohio.

Example 2

A fabric as made in the manner described in EXAMPLE 1, whereby in the alternative the flame-retardant binder composition formulation, by weight percent of bath, was as follows:

| | | |
|---|---|---|
| Chemwet MQ-2 | [wetting agent] | 0.25% |
| Defoam 525 | [silicone anti-foam] | 0.25% |
| Pyron 6135 | [halogenated polyurethane] | 16.0% |
| Chemonic TH-22 | [thickener] | 1.0% |

The above being registered to and can be obtained from Chemonic Industries, of North Carolina.

| | |
|---|---|
| Ammonium hydroxide, Aqueous | 0.50% |

As is registered to and can be obtained from B.F. Goodrich, of Ohio

| | |
|---|---|
| Water | 82.0% |

Example 3

A fabric as made in the manner described in EXAMPLE 1, whereby in the alternative 20.0% Pyron 6139 was used in place of 16% Pyron 6135 and 78.0% water was used in place of 82.0% water.

The following benchmarks have been established in connection with nonwoven fabrics, which exhibit the desired combination of durability, softness, abrasion resistance, etc., for certain home use applications.

| | |
|---|---|
| Vertical Flame Test | NFPA-701 |
| Fabric Strength/Elongation | ASTM D5034 |
| Absorbency -- Capacity | ASTM D1117 |
| Elmendorf Tear | ASTM D5734 |
| Handle-o-meter | ASTM D2923 |
| Stiffness -- Cantilever Bend | ASTM D5732 |
| Fabric Weight | ASTM D3776 |
| Martindale Abrasion Test | ASTM D4970 |
| Colorfastness To Crocking | AATCC 8-1988 |

The test data in the attached tables shows that nonwoven fabrics approaching, meeting, or exceeding the various above-described benchmarks for fabric performance in general, and to commercially available products in specific, can be achieved with fabrics formed in accordance with the present invention. For many applications, fabrics having basis weights between about 2.0 ounces per square yard and 6.0 ounces per square yard are preferred, with fabrics having basis weights of about 2.5 ounces per square yard to about 3.5 ounces per square yard being most preferred. Fabrics formed in accordance with the present invention are flame-retardant, durable and drapeable and are suitable for decorative wall cover applications.

For upholstery and drapery applications, fabrics having basis weights between about 2.0 ounces per square yard and 10.0 ounces per square yard are preferred, with fabrics having basis weights of about 3.0 ounces per square yard to about 6.0 ounces per square yard being most preferred. Fabrics formed in accordance with the present invention are flame-retardant, durable and drapeable, and are not only suitable for covering or upholstering furniture such as chairs, couches, love seats, and the like, but also draperies or hanging fabric that prevents the admittance of any ambient light through the fabric.

For window covering applications, fabrics having basis weights between about 0.5 ounces per square yard and 6.0 ounces per square yard are preferred, with fabrics having basis weights of about 1.0 ounces per square yard to about 4.0 ounces per square yard being most preferred. Fabrics formed in accordance with the present invention are flame-retardant, durable and drapeable, and are suitable for window covering applications. Window coverings of the present invention are those coverings that allow for the admittance of ambient light through the fabric, such as sheets, shades, or blinds including, but not limited to cellular, vertical, roman, soft vertical, and soft horizontal.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making a flame-retardant nonwoven fabric, comprising;

a. providing a precursor web, b. providing a three-dimensional image transfer device, c. hydroentangling said precursor web on said image transfer device to form a patterned and imaged nonwoven fabric, and d. applying a binder finish to said nonwoven fabric to impart flame-retardant properties, followed by curing of said binder finish, said binder finish comprising a halogenated urethane derivative imparting said flame-retardant properties.

2. A method of making a flame-retardant nonwoven fabric as in claim 1, wherein:

said precursor web comprise polyester fibers.

3. A method of making a flame-retardant nonwoven fabric as in claim 2, wherein:

said precursor web comprise flame-retardant polyester fibers.

4. A method of making a flame-retardant nonwoven fabric as in claim 1, wherein:

said precursor web is hydroentangled on a formainous surface prior to said step of hydroentangling said precursor web on said image transfer device.

5. A method of making a flame-retardant nonwoven fabric as in claim 1, wherein said halogenated urethane derivative is selected to comprise a halogenated derivative of a polyurethane backbone.

6. A method of making a flame-retardant nonwoven fabric as in claim 1, wherein the precursor web comprises a carded, randomized staple length fibrous matrix.

7. A method of making a flame-retardant nonwoven fabric as in claim 1 wherein the precursor web comprises fibers selected from the group consisting of polyester fibers, p-aramid fibers, n-aramid fibers, melamine fibers, and modacrylic fibers, and blends thereof.

8. A method of making a flame-retardant nonwoven fabric as in claim 1, wherein said binder finish further comprises a metallic salt extinguisant.

9. A method of making a flame-retardant nonwoven fabric as in claim 1, wherein the flame-retardant nonwoven fabric has a basis weight between about 2.0 ounces per square yard and 10.0 ounces per square yard.

10. A method of making a flame-retardant nonwoven fabric as in claim 1, wherein the flame-retardant nonwoven fabric has a basis weight between about 0.5 ounces per square yard and 6.0 ounces per square yard.

11. A method of manufacturing a flame-retardant nonwoven fabric, comprising:

a. providing a precursor web, b. providing a three-dimensional image transfer device, c. hydroentangling said precursor web on said image transfer device to form a patterned and imaged nonwoven fabric, d. applying a binder finish to said nonwoven fabric to impart flame-retardant properties, followed by curing of said binder finish, said binder finish comprising a halogenated urethane derivative imparting said flame-retardant properties, and e. dyeing of said nonwoven fabric.

12. A method of making a flame-retardant nonwoven fabric as in claim 11, wherein:

said nonwoven fabric is dyed by the method selected from the means consisting of jet dyeing, disperse dying, pad dyeing, screen printing, transfer printing, and the combinations thereof.

13. A method of making a flame-retardant nonwoven fabric as in claim 11, wherein said halogenated urethane derivative is selected to comprise a halogenated derivative of a polyurethane backbone.

14. A method of making a flame-retardant nonwoven fabric as in claim 11, wherein the precursor web comprises a carded, randomized staple length fibrous matrix.

15. A method of making a flame-retardant nonwoven fabric as in claim 11, wherein the precursor web comprises fibers selected from the group consisting of polyester fibers, p-aramid fibers, n-aramid fibers, melamine fibers, and modacrylic fibers, and blends thereof.

16. A method of making a flame-retardant nonwoven fabric as in claim 11, wherein said binder finish further comprises a metallic salt extinguisant.

17. A method of making a flame-retardant nonwoven fabric as in claim 11, wherein the flame-retardant nonwoven fabric has a basis weight between about 2.0 ounces per square yard and 10.0 ounces per square yard.

18. A method of making a flame-retardant nonwoven fabric as in claim 11, wherein the flame-retardant nonwoven fabric has a basis weight between about 0.5 ounces per square yard and 6.0 ounces per square yard.

* * * * *